US007089867B2

(12) United States Patent
Nilsen

(10) Patent No.: US 7,089,867 B2
(45) Date of Patent: Aug. 15, 2006

(54) DEVICE FOR LIFTING AND RE-POSITIONING A TRACK USED IN TELEVISION AND MOTION PICTURE INDUSTRIES

(76) Inventor: Stian Nilsen, 43 Greenwich Ave., Apt #1, New York, NY (US) 10014

( * ) Notice: Subject to any disclaimer, the term of this patent is extended or adjusted under 35 U.S.C. 154(b) by 67 days.

(21) Appl. No.: 10/847,974

(22) Filed: May 17, 2004

(65) Prior Publication Data

US 2005/0252406 A1 Nov. 17, 2005

(51) Int. Cl.
*E01B 27/17* (2006.01)

(52) U.S. Cl. ..... 104/7.1; 104/7.2; 104/4

(58) Field of Classification Search ..... 254/8 R, 254/8 B, 8 C; 414/428, 539; 104/7.1, 7.2, 104/9, 4, 7.3; 238/10 R
See application file for complete search history.

(56) References Cited

U.S. PATENT DOCUMENTS 1,505,632 A * 8/1924 Finley ..... 212/259
3,192,871 A * 7/1965 Krause, Jr. ..... 104/7.1
4,989,782 A 2/1991 McKie
5,711,227 A 1/1998 Johnson
5,887,787 A 3/1999 Sladana, III
5,971,456 A * 10/1999 van Capelleveen ..... 294/88
6,033,177 A * 3/2000 Kooima ..... 414/438
6,349,994 B1 2/2002 Chapman
6,435,421 B1 8/2002 Peterson
6,557,775 B1 * 5/2003 Brinson et al. ..... 238/10 R
6,626,117 B1 9/2003 Chapman
2003/0196565 A1 * 10/2003 Decker et al. ..... 104/7.2

* cited by examiner

*Primary Examiner*—Frantz F. Jules
(74) *Attorney, Agent, or Firm*—Larry Liberchuk

(57) ABSTRACT

A device for use in television and motion picture industries lifts and re-positions a track on which camera dolly or crane is located. The device includes a first bar member of a substantially elongated shape comprising a hinge, a first caster wheel assembly, and a first track hook which is positioned at one end of the first bar member. A second bar member of a substantially elongated shape shorter than the first bar member is pivotably attached to the first bar member via the hinge such that when in a closed position the first and second bar members form a substantially straight line. The second bar member further comprises a second caster wheel assembly and a second track hook which is positioned at one end of the second bar member, this one end of the second bar member being at an opposite location than the other end of the first bar member along the substantially straight line. When each track hook is positioned under each rail of the track and downward force is applied to the first bar member, the first and second bar members form the substantially straight line thereby lifting the track off the ground. The track and a camera dolly can then be rolled on wheels to a new location quickly and effortlessly.

8 Claims, 8 Drawing Sheets

DEVICE FOR LIFTING AND RE-POSITIONING A TRACK USED IN TELEVISION AND MOTION PICTURE INDUSTRIES

BACKGROUND OF THE INVENTION

The present invention is related to a lifting device. More specifically, the present invention is related to a device, used in television and motion picture industries, for lifting and re-positioning a track on which camera dolly or crane is located.

Camera dollies and cranes are widely used in television and motion picture industries during a production sequence. It is well known that a camera dolly has a moveable arm for supporting a camera. The camera dolly also contains wheels to enable its operators or grips to quickly transport the camera to a new location in a filming sequence.

Typically it is desirable to eliminate or minimize any camera vibration during a shooting sequence in order to avoid lowering an image quality. To this end, the camera dolly is generally equipped with wide pneumatic tires designed to absorb slight surface imperfections. When the surface, however, is quite bumpy and irregular, a track typically comprising pair of rails is assembled on the ground to allow the camera dolly to roll thereon. The track, as used on a film set, smoothes out many surface imperfections, thereby providing substantially vibration-free shooting conditions for camera operators.

Although the track creates fairly smooth surface for shooting scenes thereby eliminating the vibration and shaking of the camera, it is disadvantageous in another aspect. In particular, the track requires typically laborious re-positioning if the camera has to be in a spot that is not along the track path. Even though tracks can be made curvilinear, it is clear that the movement of the camera dolly is nevertheless limited to the track path.

Moving the track is a very labor-intensive process that requires removing the camera dolly with its camera, re-positioning the track, and then placing the camera dolly back onto the track. Alternatively, the track can be moved without removing the camera dolly, but this requires significant physical effort. In either case, valuable time is expended in this labor and time-consuming process.

A need therefore exists for a device that addresses the above concerns and solves this long-felt need of easily and quickly re-positioning a track used in television and motion picture industries.

SUMMARY OF THE INVENTION

It is an object of the present invention to provide a device for lifting and re-positioning a track on which camera dolly or crane is located.

The above and other objects are achieved by a device for lifting and re-positioning a track comprising two rails used in television and motion picture industries. According to one embodiment of the present invention, a first bar member of a substantially elongated shape comprises a hinge, a first caster wheel assembly, and a first track hook which is positioned at one end of the first bar member. A second bar member of a substantially elongated shape shorter than the first bar member is pivotably attached to the first bar member via the hinge such that when in a closed position the first and second bar members form a substantially straight line. The second bar member further comprises a second caster wheel assembly and a second track hook which is positioned at one end of the second bar member, this one end of the second bar member being at an opposite location than the other end of the first bar member along the substantially straight line. When each track hook is positioned under each rail of the track and downward force is applied to the first bar member, the first and second bar members form the substantially straight line thereby lifting the track off the ground.

BRIEF DESCRIPTION OF THE DRAWINGS

The present invention is illustrated in the figures of the accompanying drawings which are meant to be exemplary and not limiting, and in which like reference characters refer to like or corresponding parts.

DETAILED DESCRIPTION OF PREFERRED EMBODIMENTS

Figure 1:
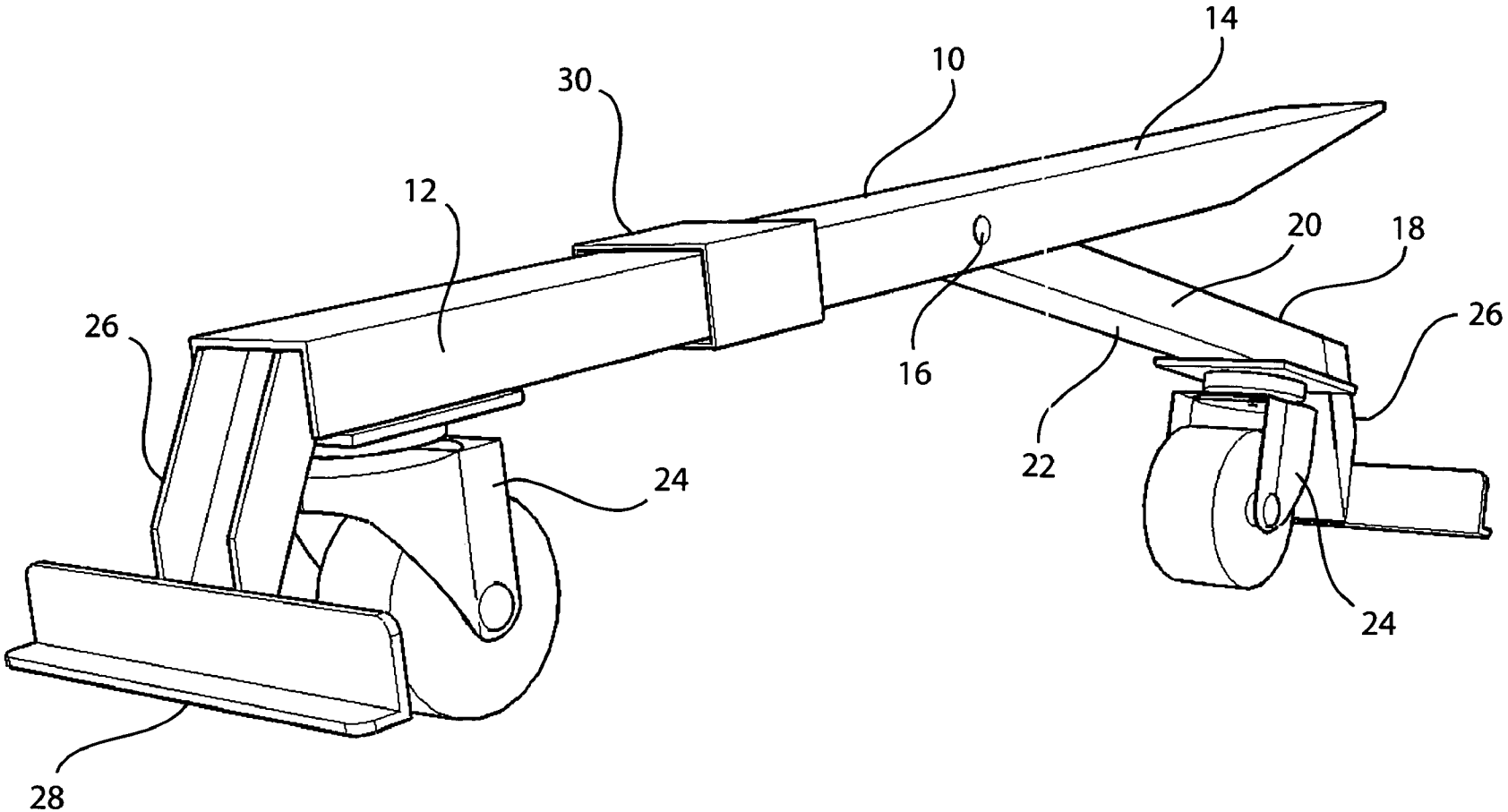
FIG. 1 shows one embodiment of the device for lifting and re-positioning a track in open position in accordance with the present invention.

FIG. 1 shows one embodiment of the present invention. As shown in the figure, a bar member 10, which provides leverage for the inventive lifting device as explained in detail hereinbelow, comprises 2 substantially flat side members 12. Each side member 12 may be tapered at one end. As further shown in FIG. 1, the bar member 10 comprises a substantially top member 14 positioned at a substantially 90° angle with respect to each of the flat side members 12. The side and top members thereby form a cavity. Inside the cavity and attached to the side members 12, as illustrated in FIG. 1, is a hinge 16.

Turning on the hinge 16 is a shorter bar member 18, a so-called drop-down bar, which folds into the cavity of the bar member 10. The bar member 18 comprises substantially side members 20 and a bottom member 22.

Each of the bar members 10, 18 includes a caster wheel assembly 24 for re-positioning and moving about a track on which camera dolly or crane is located. The caster wheel assembly 24 comprises a plate for attaching the assembly, a bracket, an axle, a wheel, and other elements as known to those skilled in the art of caster wheel assemblies. The caster wheel assembly 24 is positioned at respective opposite ends of each bar member 10, 18. As further shown in FIG. 1, attached at opposite ends of each bar member 10, 18 and positioned near the respective caster wheel assembly 24 are track hook supporting member 26 and track hooks 28. The track hook supporting members are positioned at a predetermined angle with respect to each bar member 10, 18 in order to provide a proper positioning for the track hooks 28. The track hooks 28 are used for resting each rail of the track after securing the lifting device in position.

Figure 2:
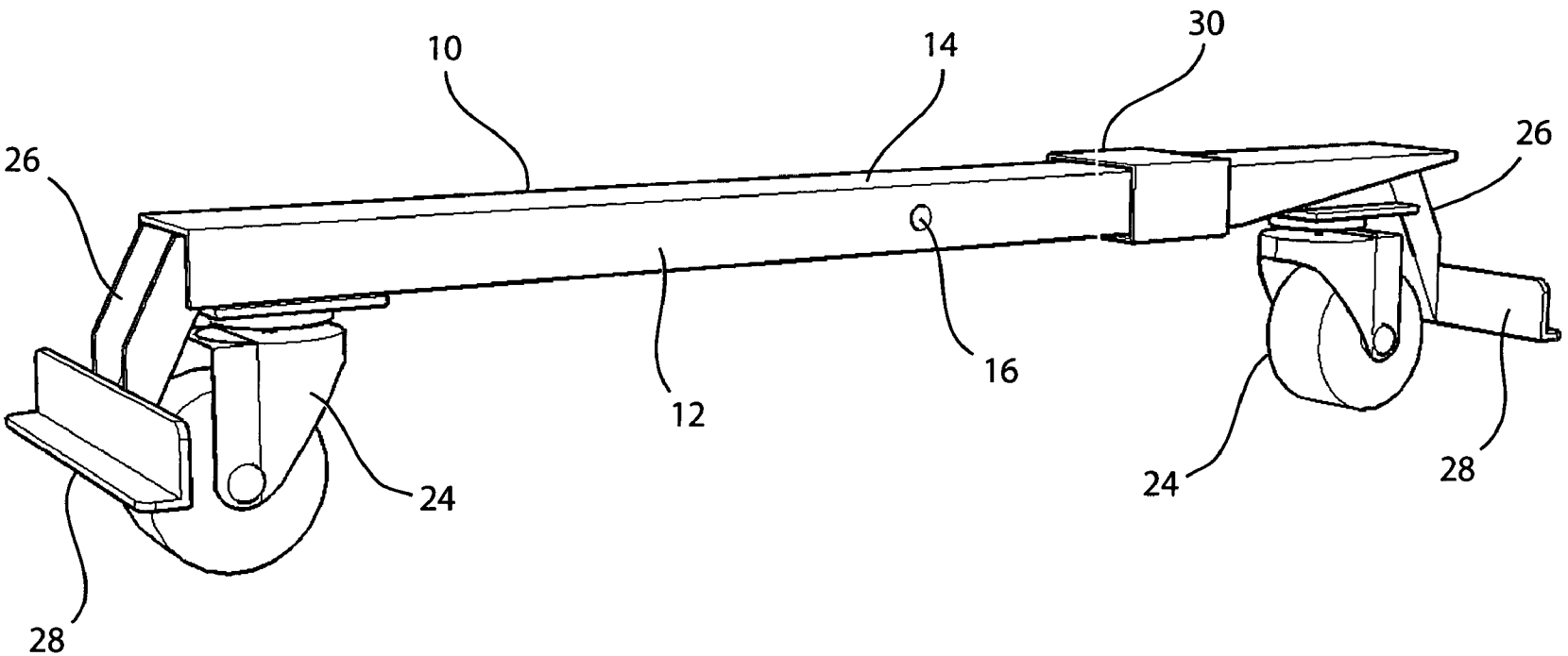
FIG. 2 shows the inventive device in closed position according to one embodiment of the present invention.

FIG. 1 also shows lock 30, which is slideably moveable along the bar member 10. Once the lifting device is in position, the lock 30 is moved towards the caster wheel assembly 24 of the bar member 18 in order to prevent jack-knifing of the device during the lifting motion. FIG. 2 shows the inventive lifting device according to the present invention in such closed or locked position.

Figure 3:
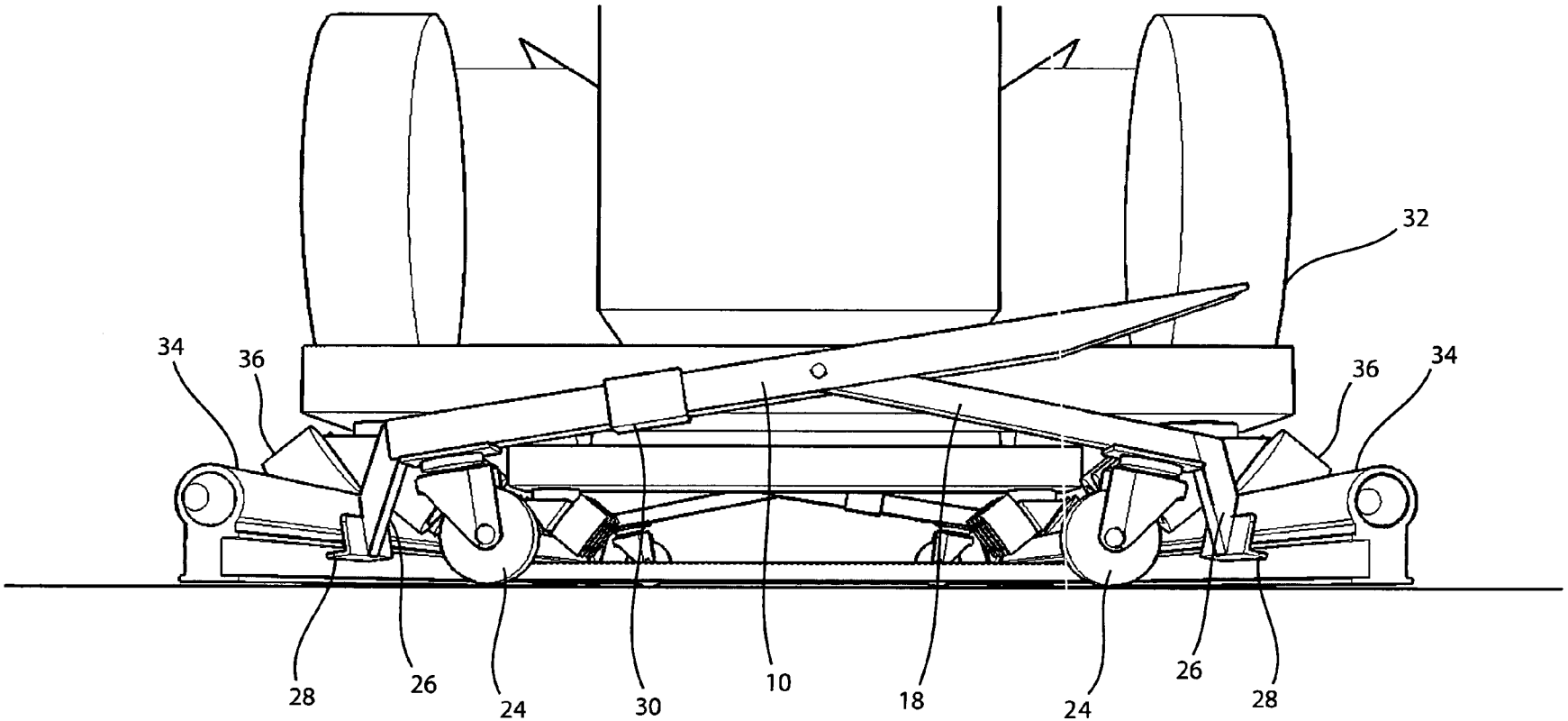
FIG. 3 shows the operation of the inventive device in open position when the track in not off the ground yet.
Figure 4:
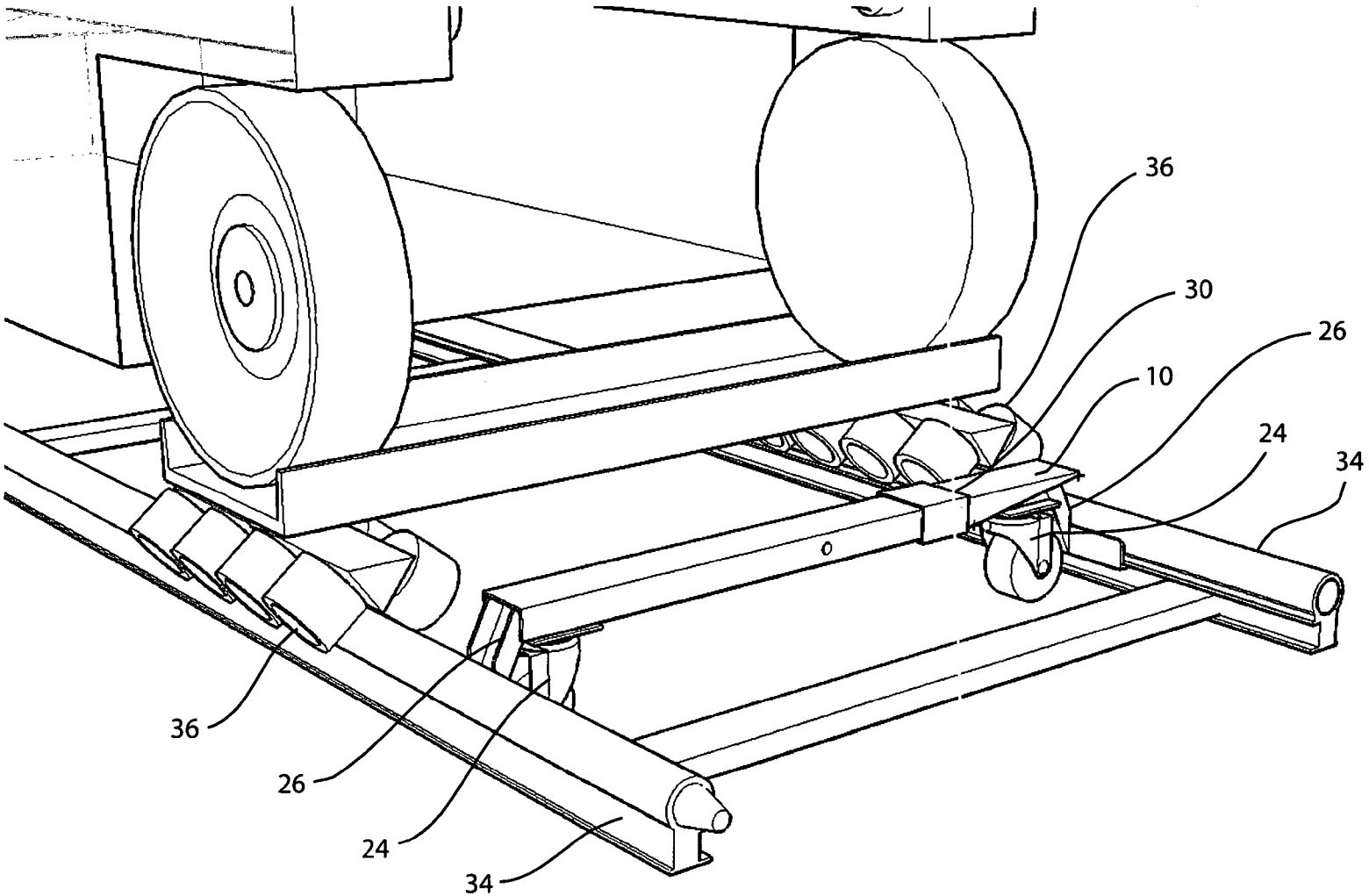
FIG. 4 shows the operation of the inventive device in closed position when the track is off the ground.
Figure 5:
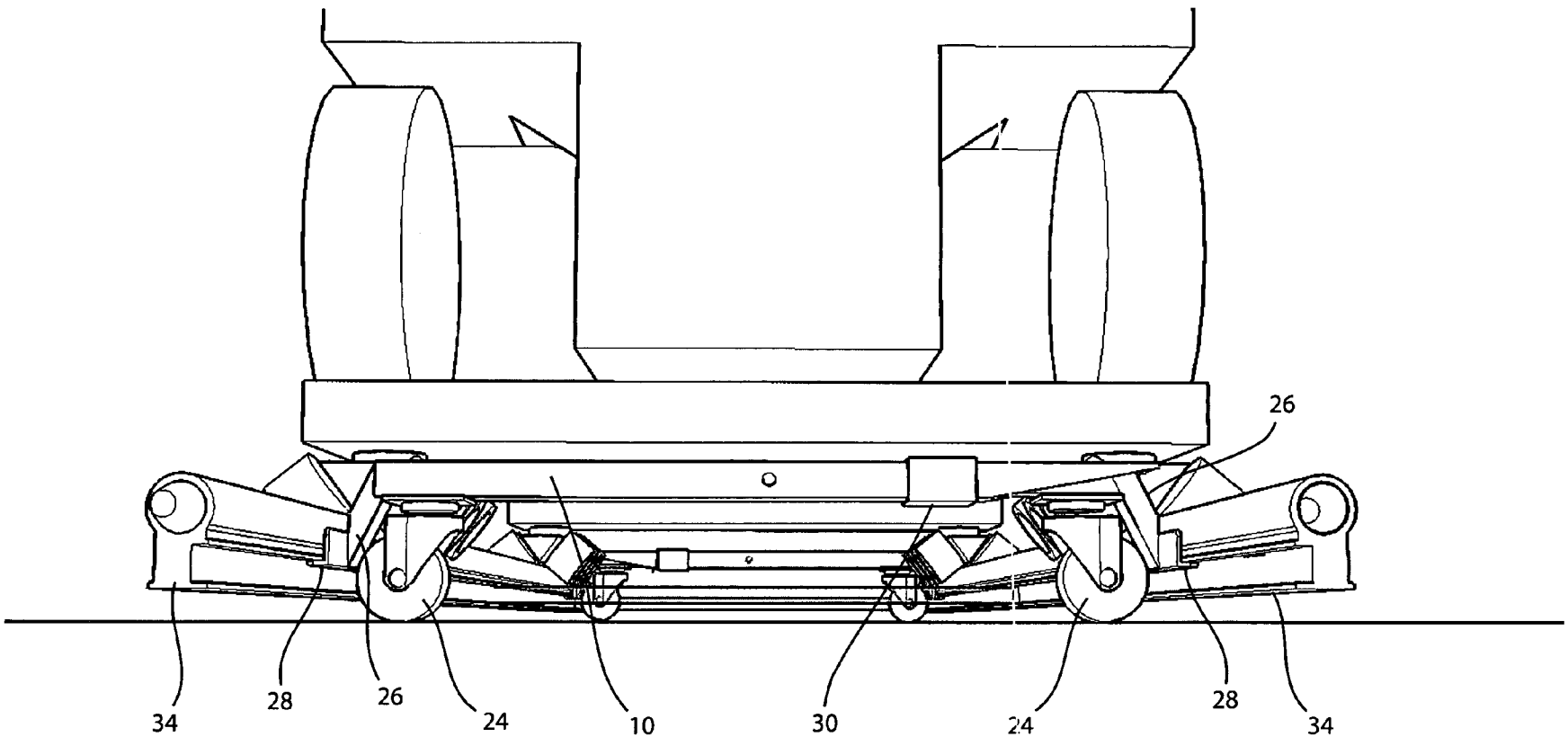
FIG. 5 shows the ground clearance for the track obtained through the use of the inventive device.

FIG. 3 shows the inventive lifting device in operation according to the present invention. As shown in the figure, camera dolly 32—a lower portion of which is illustrated only in order not to detract from the present invention—is positioned on the track comprising two rails 34. The camera dolly includes bogie wheels 36 on each side of the track in order to enable a person to move it along the track, as well known in the art of film and television industries. According to the present invention, the inventive lifting device is positioned with respect to the track in such a way that a lip of each rail 34 rests on the track hook 28. In this case as shown in the figure, the inventive lifting device is in open position. After positioning the inventive lifting device under the rails 34, the person applies downward force to the bar member 10 so that the two bar members 10, 18 form substantially a straight line. The inventive lifting device is now in closed position, and the lock is now moved toward the caster wheel assembly 24 of the bar member 18 to secure the two bar members 10, 18 in place, as shown in FIG. 4. Due to the length of the bar member 10, sufficient leverage exists to enable the person to lift the rails of the track slightly off the ground without much effort. Ground clearance is thereby obtained. After this procedure is repeated with a second inventive device positioned at another end of the track, the entire track with a dolly camera on it is easily maneuverable, as shown in FIG. 5. By simply rolling the track on the wheels of the inventive device, the track and all the equipment located thereon can be re-positioned to a different location quickly and effortlessly.

Figure 6:
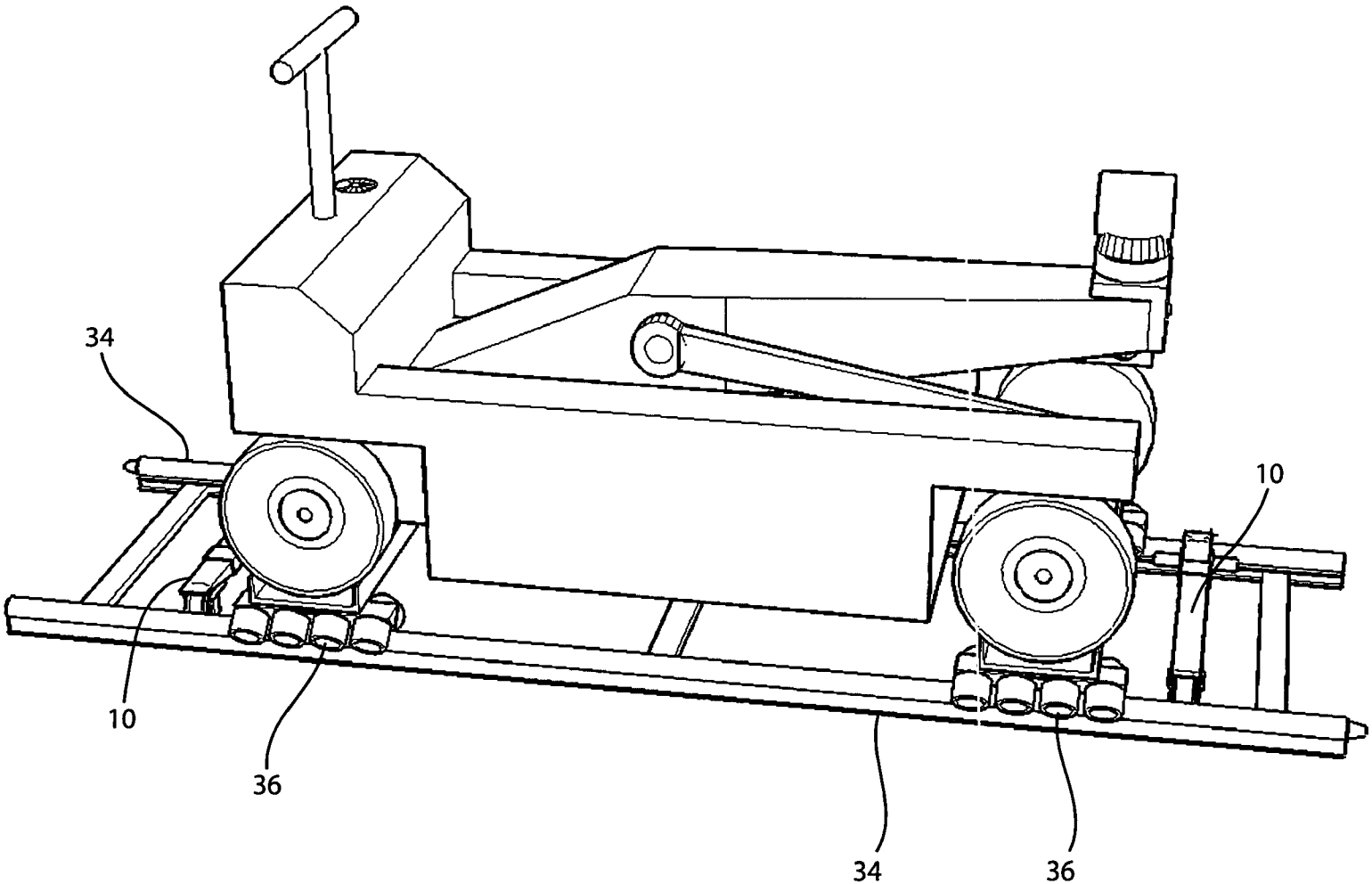
FIG. 6 shows the track and camera dolly repositioned to a new.

After moving the track to a desired location, the person slides the lock 30 back toward the caster wheel assembly 24 of the bar member 10 to unlock the device. The bar member 10 is then raised to an open position, and the track is lowered onto the ground, as shown in FIG. 6. Thereafter, the inventive lifting device is removed from the track.

Figure 7:
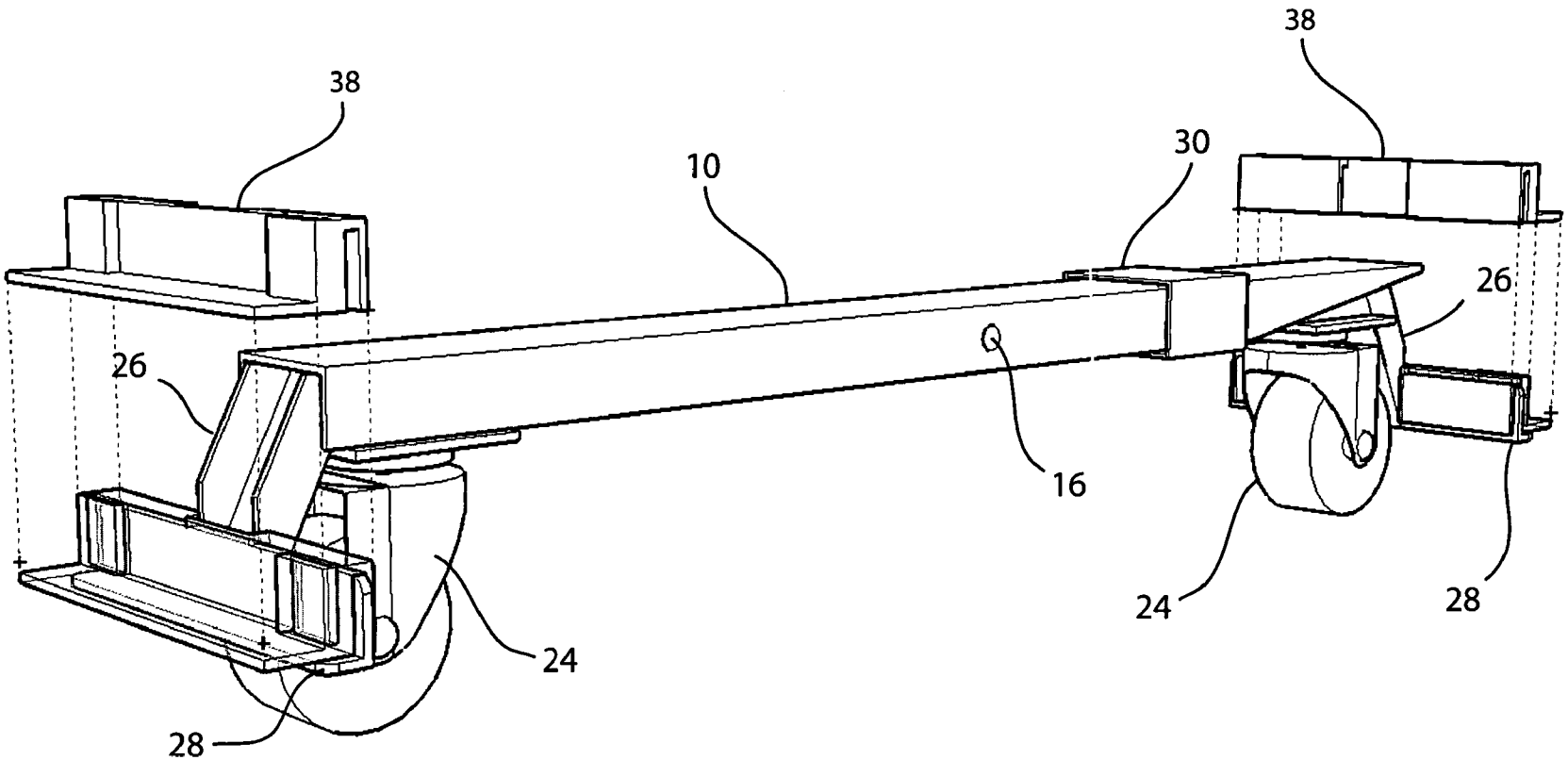
FIG. 7 shows adapters for track hooks in accordance with the present invention.
Figure 8:
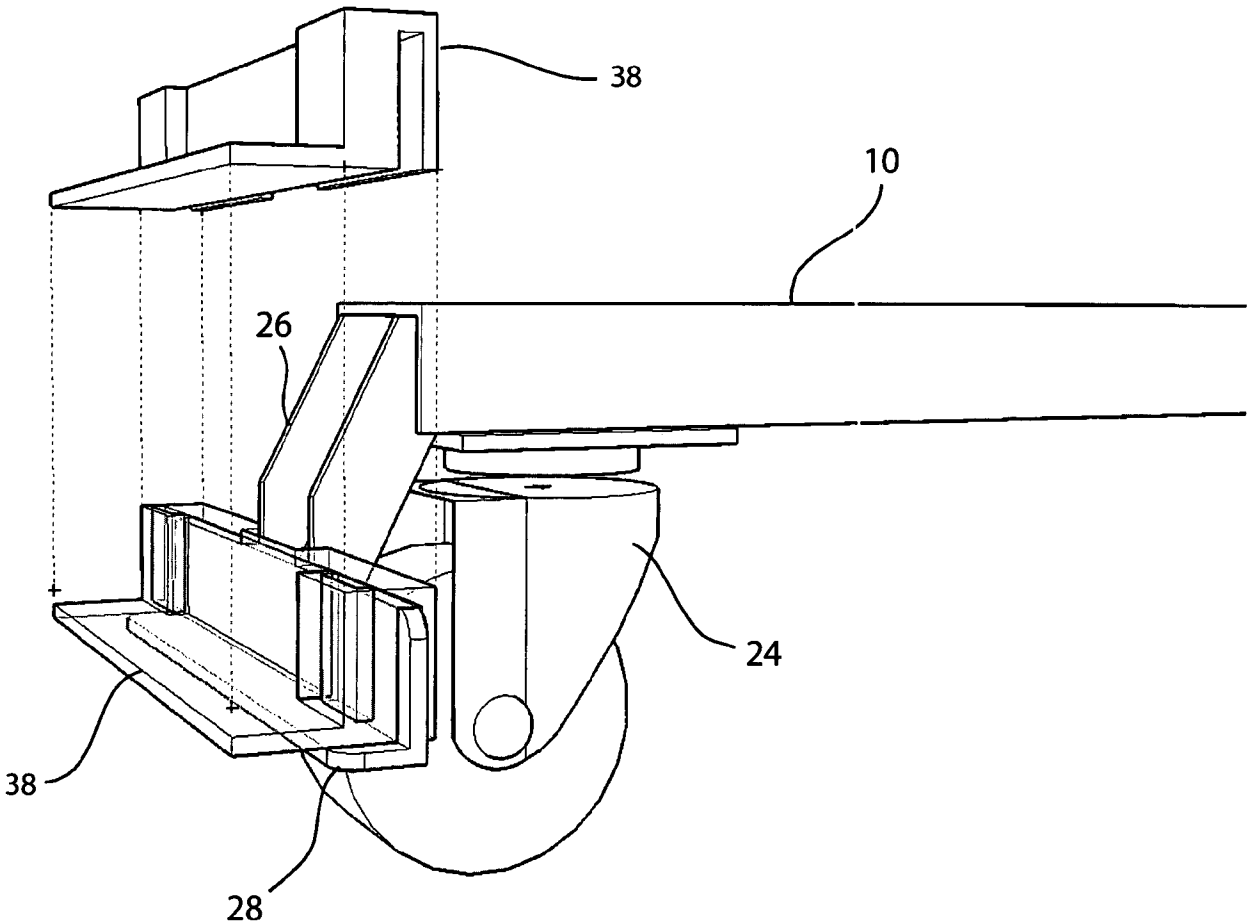
FIG. 8 shows more detailed view of the adapters being fitted onto the track hooks according to the present invention.

FIG. 7 shows adapters 38 that may be used for track hooks 28 if the rails comprising the track are different in shape than the ones typically in use. In particular, the adapters 38 are fitted onto the track hooks as shown in detail in FIG. 8. It is understood, of course, that adapters of other shapes and forms may be employed in those cases where tracks of other designs are in use.

It is further understood that the bar member 10 may be a unitary piece such that side members are bent at an angle to the top member. In this case, there is no welding seam or any other attachment between each of the side members and the top member. Alternatively, the bar member 10 may comprise side members welded or securely attached to the top member, thereby effectively forming a 3-piece member.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. A stand alone device for lifting and re-positioning a track comprising two rails used in television and motion picture industries, comprising:

a first bar member of a substantially elongated shape comprising a hinge, a first caster wheel assembly, and a first track hook which is positioned at one end of said first bar member; and a second bar member of a substantially elongated shape shorter than said first bar member pivotably attached to said first bar member via said hinge such that when in a closed position said first and second bar members form a substantially straight line, said second bar member comprising a second caster wheel assembly and a second track hook which is positioned at one end of said second bar member, said one end of said second bar member being at an opposite location than said one end of said first bar member along said substantially straight line, such that when each of said track hooks is positioned under each of said two rails of said track and thereafter a person applies a manual downward force to said first bar member, said first and second bar members form said substantially straight line thereby lifting said track off the ground.

2. The device according to claim 1, wherein said first bar member further comprises a locking member slideably moveable along the length of said first bar member, such that when said first and second bar members are in said closed position, said locking member is moved toward said second caster wheel assembly in order to prevent said device from jack-knifing.

3. The device according to claim 1, further comprising a pair of adapters to fit over said first and second track hooks respectively for use with different rails of a track.

4. The device according to claim 1, wherein said hinge is located in substantially a center of said first bar member lengthwise.

5. The device according to claim 1, wherein said first bar member comprises two side members, substantially parallel each other, and a top member joining said two side members at substantially a 90 degree angle, thereby forming a cavity into which said second bar member folds.

6. The device according to claim 1, wherein said second bar member comprises two side members, substantially parallel each other, and a bottom member joining said two side members at substantially a 90 degree angle.

7. The device according to claim 1, wherein said track has a camera dolly thereon and is lifted with said camera dolly remaining on said track.

8. The device according to claim 7, wherein said track is re-positioned by rolling it on said caster wheels with said camera dolly remaining on said track.

* * * * *